US006571958B1

(12) United States Patent
Malatesta et al.

(10) Patent No.: US 6,571,958 B1
(45) Date of Patent: Jun. 3, 2003

(54) MAIL PROCESSING DOUBLE SEPARATOR AND SENSING ASSEMBLIES AND METHODS

(75) Inventors: James Malatesta, Hockessin, DE (US); Matthew Schroeder, Wilmington, DE (US)

(73) Assignee: Tritek Technologies, Inc., Hockessin, DE (US)

( * ) Notice: Subject to any disclaimer, the term of this patent is extended or adjusted under 35 U.S.C. 154(b) by 0 days.

(21) Appl. No.: 09/677,012

(22) Filed: Sep. 29, 2000

Related U.S. Application Data

(60) Provisional application No. 60/157,262, filed on Oct. 1, 1999.

(51) Int. Cl.[7] ..... B07C 5/00; B65H 5/08

(52) U.S. Cl. ..... 209/643; 209/900; 209/919; 271/11; 271/104; 271/106

(58) Field of Search ..... 209/584, 643, 209/900, 918, 919; 271/104, 105, 106, 107, 11

(56) References Cited

U.S. PATENT DOCUMENTS 3,976,291 A * 8/1976 Bernardi et al. ..... 271/104 X
5,181,706 A * 1/1993 Yamamoto et al. ..... 271/104 X
5,226,547 A 7/1993 Malatesta ..... 209/657
5,398,922 A 3/1995 Malatesta ..... 271/11
5,521,365 A 5/1996 Malatesta ..... 235/454
5,544,758 A 8/1996 Malatesta et al. ..... 209/584
5,722,652 A * 3/1998 Yoshida et al. ..... 271/11
6,145,829 A * 11/2000 Furmanski et al. ..... 271/106 X

FOREIGN PATENT DOCUMENTS

DE 3608067 * 9/1987 ..... 271/104

* cited by examiner

*Primary Examiner*—Tuan N. Nguyen
(74) *Attorney, Agent, or Firm*—Schnader Harrison Segal & Lewis LLP

(57) ABSTRACT

A double separator assembly used for a mail sorting system. A conveyor system facilitates movement of mail items through the double separator assembly. A substantially non-rotatable component is positioned proximate to the conveyor system. A mail driving assembly positioned proximate to the conveyor system if provided downstream from the friction component and in functional relation thereto. The mail driving assembly further includes an idler roller and a force generating device to hold the mail item against the conveyor system. Further disclosed are a mail processing system including a double separator, a mail processing method, a mail sensing assembly and method.

24 Claims, 6 Drawing Sheets

MAIL PROCESSING DOUBLE SEPARATOR AND SENSING ASSEMBLIES AND METHODS

This application is related to and claims priority from co-pending U.S. Provisional Application Ser. No. 60/157,262 filed Oct. 1, 1999, titled Mail Sorting Machine Drop Box and Double Separator Module, the disclosure of which is hereby incorporated by reference.

FIELD OF THE INVENTION

The invention relates to mail sorting systems, and more particularly to singulation assemblies used in such systems.

BACKGROUND OF THE INVENTION

Mail processing systems typically comprise a feeder assembly that singulates mail items and delivers it to a sorting assembly. "Singulate" means to separate mail items that have been "double fed" into the system to enable items to be processed individually. Any mail items moving through the processing system that are at least partially adjacent to one another are considered "double fed." Mail items may include for example, letters, newspapers, magazines, postcards and padded envelopes. The sorting assembly may scan and sort mail items, for example by address. A transport assembly then moves the mail items to sorting bins. It is desirable for the sorting system to process mail at a high rate of speed. Available systems are capable of sorting mail at speeds of greater that 30,000 mail items per hour. Portions of the sorting systems such as scanners and transport assemblies can readily attain these speeds. A limiting factor in a sorting system's speed may be the system's ability to reliably singulate or separate mail items at the desired speed. Accordingly, there is a need for a singulation assembly capable of reliably singulating mail items, preferably at high rates of speed.

SUMMARY OF THE INVENTION

The invention includes a double separator assembly used in a mail processing system. A conveyor system facilitates movement of mail items through the double separator assembly. A substantially nonrotatable friction component is positioned proximate to the conveyor system.. A mail driving assembly positioned proximate to the conveyor system is provided downstream from the friction component and in functional relation thereto. The mail driving assembly further includes an idler roller and a force generating device to hold the mail item against the conveyor system. Further disclosed are a mail processing system comprising a double separator, and a mail processing method, a mail sensing assembly and method.

DETAILED DESCRIPTION OF THE INVENTION

Figure 1:
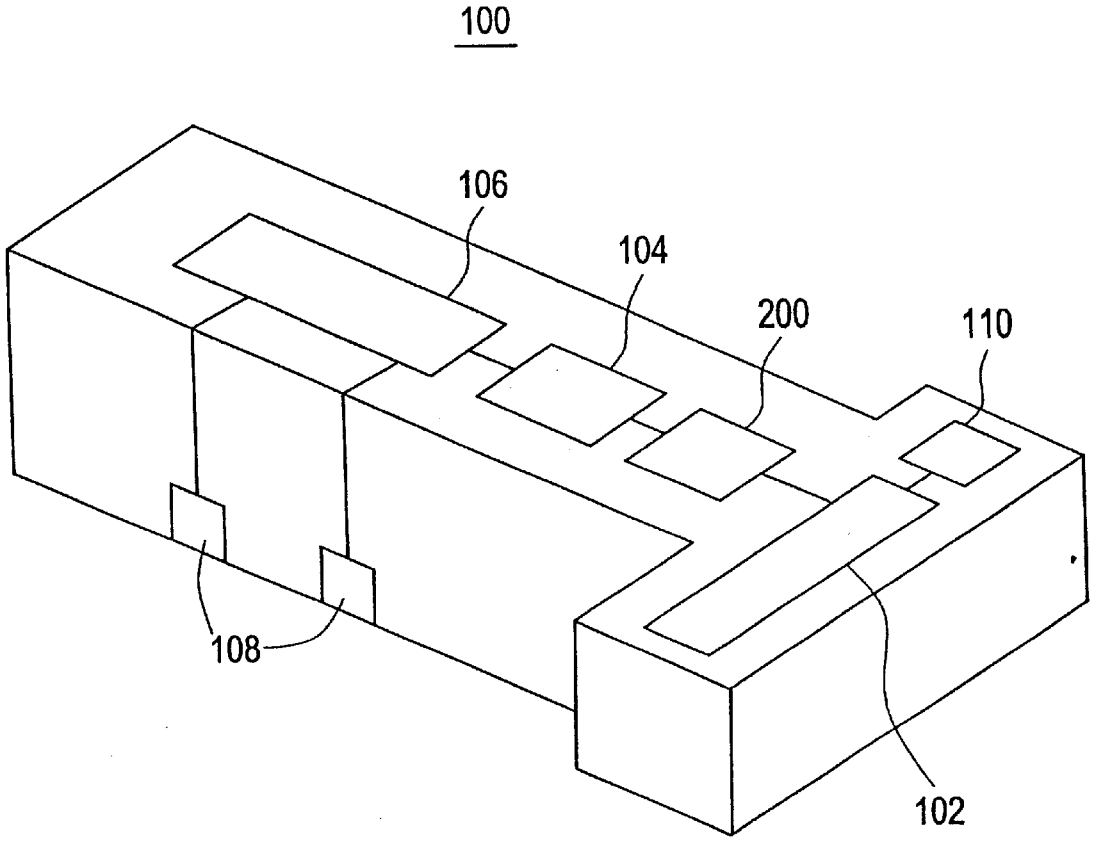
FIG. 1 depicts a mail processing system according to an illustrative embodiment of the invention.

A double separator assembly for use in a mail processing system is disclosed. FIG. 1 depicts schematic diagram of a mail processing system 100 in which embodiments of the mail double separator system may be incorporated. A feeder assembly 102 is provided for receiving a plurality of mail items. Feeder assembly 102 includes a double separator assembly 200 to separate mail items from one another. A transport assembly 104 is in functional cooperation with and proximate to feeder assembly 102 to receive mail therefrom and sort mail items into categories. A sorter assembly 106 is in functional cooperation with and proximate to transport assembly 104 for delivery of sorted mail items to corresponding receptacles 108. Optionally, the system may be operated by computer 110. Those skilled in the art will understand that the components depicted in FIG. 1 are functionally and/or electrically connected by, for example, a conveyor system.

Figure 2:
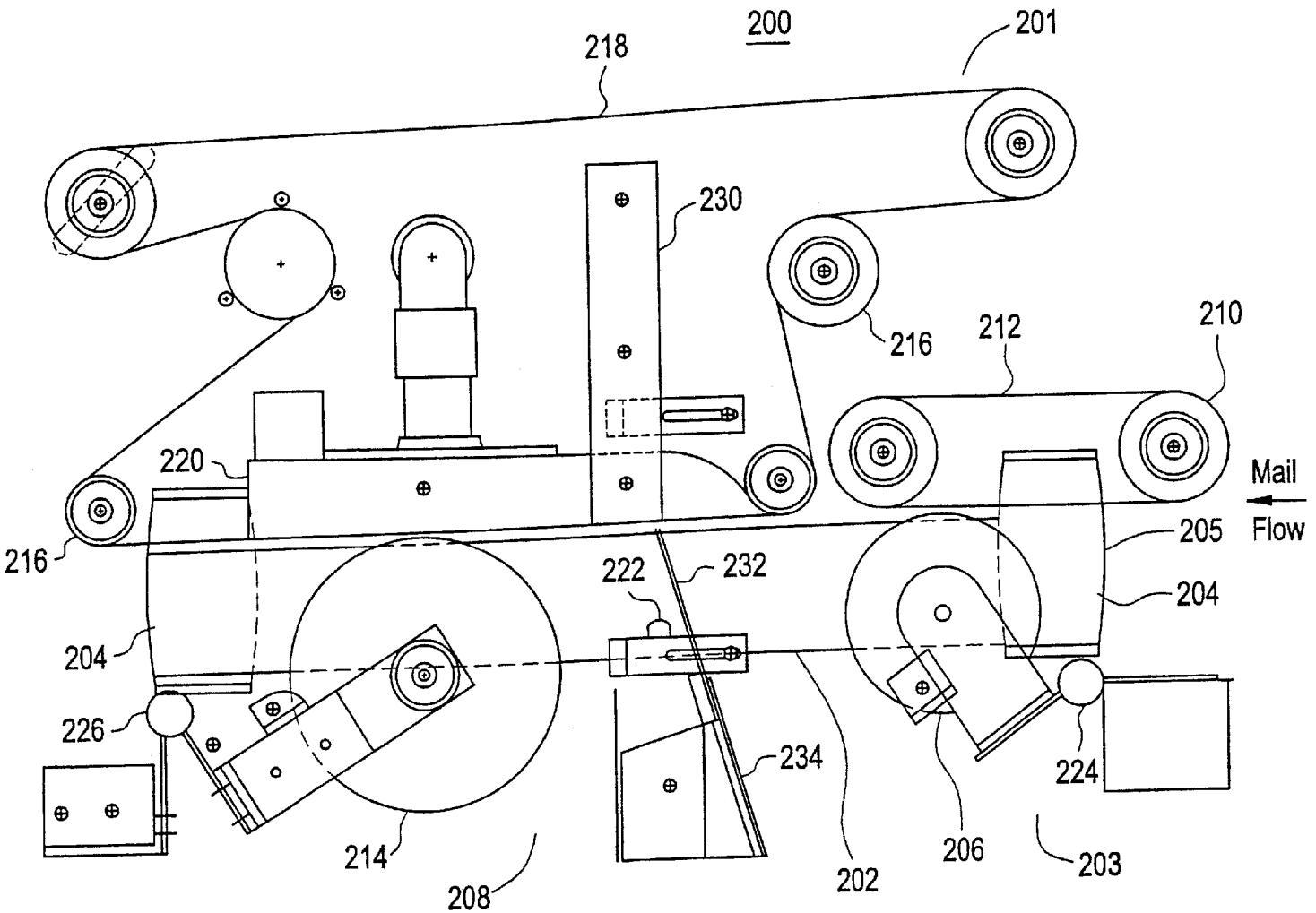
FIG. 2 depicts a top view of a mail double separator assembly according to an illustrative embodiment of the invention.
Figure 3:
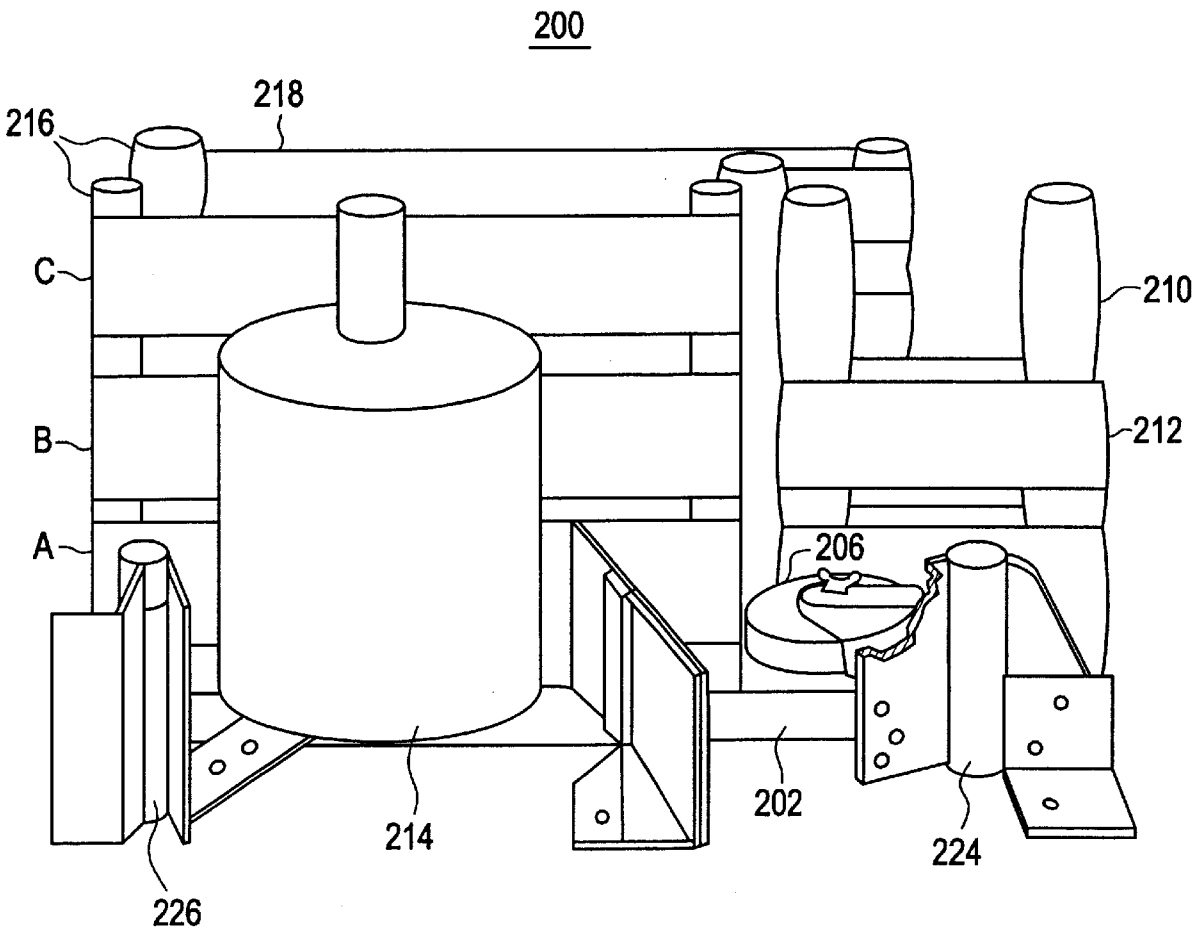
FIG. 3 depicts a side view of a mail double separator assembly according to an illustrative embodiment of the invention.

An illustrative embodiment of the double separator assembly is depicted in FIGS. 2 and 3. FIG. 2 is a top view of the double separator assembly 200, and FIG. 3 is a side view. The double separator assembly comprises a conveyor system 201 to facilitate movement of mail items through the double separator assembly. A friction assembly 203 including a substantially nonrotatable friction component 206 is positioned proximate to conveyor system 201. A mail driving assembly 208 is provided positioned proximate to conveyor system 201 and downstream from friction component 206 and in functional relation thereto. Also included in mail driving assembly 208 is an idler roller 214 and an optional force generating device (depicted as a vacuum generating device 220 in FIG. 2) to hold the mail item against conveyor system 201. The combination of forces acting on the mail items separates any double fed mail items. These forces include that from the friction component 206, force generating device (such as vacuum 220) and conveyor system 201.

In an illustrative embodiment of the double separator assembly a conveyor system 201 comprises a mail feed conveyor system, a friction assembly conveyor system and a driving assembly conveyor system which are parts of mail feed assembly 205, friction assembly 203 and driving assembly 208, respectively. The mail feed conveyor system comprises one or more mail feed belts 202, and a plurality of mail feed rollers 204. Mail feed belt(s) 202 are functionally supported by mail feed rollers 204. Mail feed belt(s) 202 facilitate movement of mail items through double separator assembly 200. In a preferred embodiment mail feed belt(s) are perpendicular to friction assembly and driving assembly belts. The friction assembly includes a friction component 206 optionally mounted to a friction assembly hinge 224. The friction assembly conveyor portion comprises a plurality of friction assembly rollers 210 functionally supporting at least one friction assembly belt such that the belts are substantially tangent to friction component 206. Friction component 206 is substantially nonrotatable but may move in functional relation to friction assembly hinge 224. Mail driving assembly 208 is positioned downstream from friction assembly 203 and is in functional relation thereto. "Downstream" means further along the mail flow path. Mail driving assembly 208 includes a substantially rotatable idler roller 214 and optionally a mail driving assembly hinge. The mail driving assembly conveyor system portion comprises a plurality of driving assembly rollers 216 and at least one driving assembly belt 218. Driving assembly belt(s) 218 are functionally supported by driving assembly rollers 216 such that driving assembly belt(s) 218 are substantially tangent to idler roller 214. "Substantially tangent" includes idler roller 214 (or friction component 206 as used above) being partially pressed into the tangent belt. At least one roller of the rollers 216 provides motion to belt(s) 218. In a particular illustrative embodiment of the invention at least one driving assembly belt 218 comprises one or more openings through which a vacuum may be drawn to provide a force on the mail item directed toward belt(s) 218 to hold the mail item against belt(s) 218.

Figure 4:
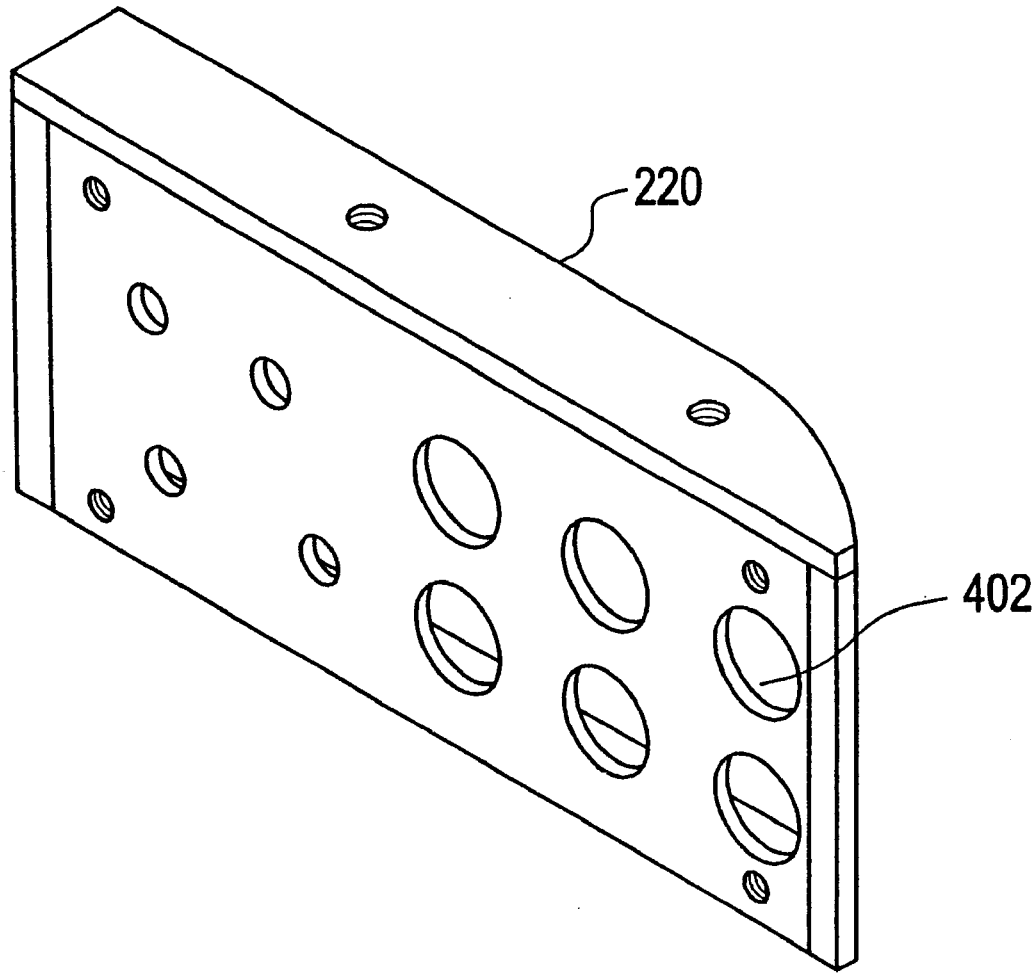
FIG. 4 depicts a vacuum chamber according to an illustrative embodiment of the invention.
Figure 5:
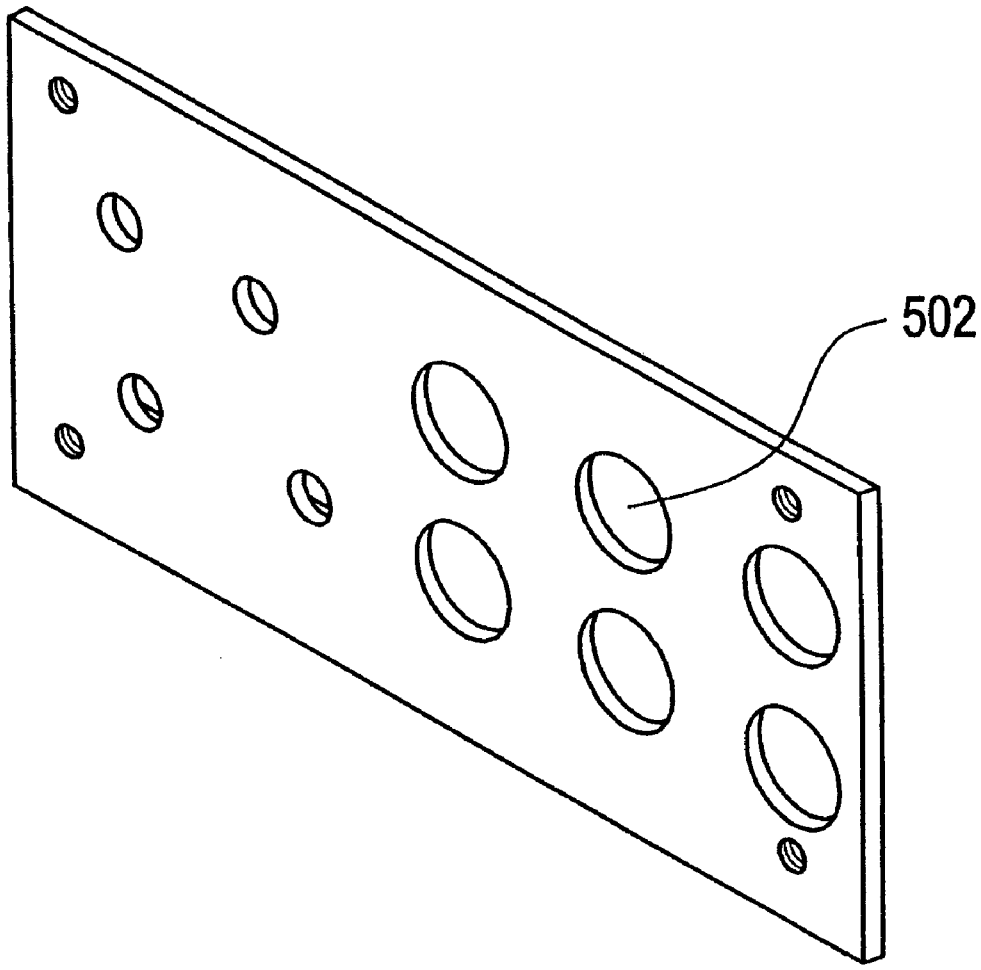
FIG. 5 depicts a plate to be used in conjunction with the vacuum chamber according to an illustrative embodiment of the invention.

Vacuum 220 is one example of a force generating device to hold mail items against the conveyor system which would be used in the illustrative embodiment provided above. An illustrative vacuum chamber 220 is depicted in FIG. 4. Bracket 230 may be used to mount vacuum 220 to the mail processing assembly. Vacuum chamber 220 comprises a one or more openings 402 through which a vacuum is drawn. Optionally a plate with corresponding openings 502 as depicted in FIG. 5 may be placed over vacuum chamber 220 for protection and replaceability. A belt from conveyer system 201 also includes one or more openings. The number and position of belt openings preferably matches that of openings 402 so that as the belt moves by vacuum 220 the belt openings align with vacuum openings 402 as the belt moves around a roller. When the belt moves by vacuum 220 and vacuum openings 402 are aligned with belt openings, the vacuum generated by vacuum 220 is applied in sufficient force to hold a mail item to the belt and to transport it along the system. Flap 232 may be used to facilitate guiding mail to the belt. Flap 232 may be secured to the assembly by bracket 234. If the mail item has been double fed it is separated from the second mail item as the items come by friction component 206 because friction component 206 holds back the second item while the belt through which the vacuum is drawn holds the first item and moves it away from the second mail item by the conveyor action. The belt to which the separated mail item is held is preferably a part of the driving conveyor assembly. The high speed which is typical of mail processing machines facilitates the separation of the mail items. Any other force generating device would function by similar principles of opposing or partially opposing forces. Other techniques or devices that provide the necessary force to hold the item to the conveyor are within the spirit and scope of the invention.

Friction component 206 provides a significantly more reliable separation action than prior art separators that rely on the friction between double fed items for separation as friction component 206 may be provided with a greater coefficient of friction than a mail item. Friction component 206 may be any material with a high enough coefficient of friction to facilitate separation of double fed mail. Examples of materials for friction component 206 include, but are not limited to, neoprene, polyurethane, grinding wheel materials, and sandpaper. Antiskid strips such as those made by 3M Company may also be used. In an exemplary embodiment friction component 206 is a grinding wheel having a grit in the range of about 150 to about 200. Readily available grinding wheels provide the necessary amount of friction for most mail items. Sufficient friction from a belt is an additional example of a mechanism that may be used to hold a mail item to a conveyor.

In an illustrative embodiment of the invention a friction assembly hinge 224 is included in functional relation to friction component 206. Hinge 224 applies pressure towards friction component 206 thereby forcing friction component 206 toward friction assembly belt 212 to hold at least one mail item therebetween. A driving assembly hinge 226 may also be included. Driving assembly hinge 226 is in functional relation to idler roller 214 to apply pressure toward idler roller 214 thereby forcing idler roller 214 toward the driving assembly conveyor system to hold a mail item therebetween. Mechanisms to force idler roller 214 or friction component 206 toward conveyor system 201 to adjust the system for different thicknesses of mail items may be implemented. For example, a spring mechanism that pushes idler roller 214 or friction component 206 in a straight line, arc or other path toward the conveyor system may be used. The mechanism may be one that provides incremental spacing adjustments between idler roller 214 or friction component 206 and the conveyor system, which may comprise for example a bracket and tightening mechanism.

In an exemplary embodiment of the invention the driving assembly conveyor system comprises three substantially parallel driving assembly belts 218, designated as A, B and C on FIG. 3. In a further illustrative embodiment of the invention the friction assembly conveyor system comprises two friction assembly belts 212 substantially parallel to one another and disposed around friction assembly rollers 210 wherein rollers 210 are driven by a feeder system belt (not shown) disposed on at least one of friction assembly rollers 210.

In one embodiment of the invention at least one driving assembly belt 218 comprises one or more openings through which the vacuum may be drawn to hold the mail item against the belt. In an exemplary embodiment of the invention the openings are in a grouped pattern. An illustrative pattern size is in the range of about 10 to about 15 inches along the length of the belt. A belt may have one or more patterns thereon. The number of patterns on a single belt depends on the size of the pattern and the length of the belt. The openings however may be any shape, number or size that enables a sufficient vacuum to be drawn to hold mail items to the belt.

Figure 6:
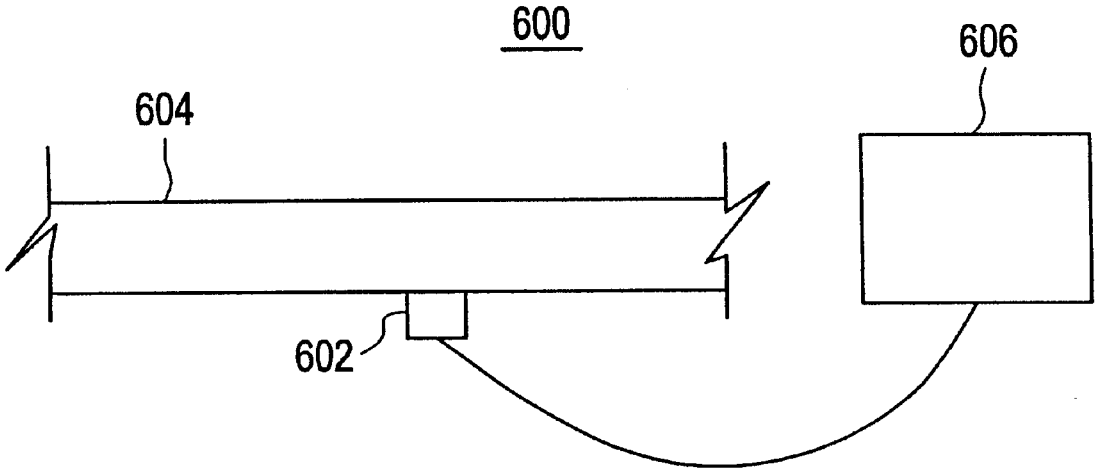
FIG. 6 depicts a mail sensing assembly according to an illustrative embodiment of the invention.

Further disclosed is a mail sensing assembly used in a mail processing system. FIG. 6 depicts an illustrative embodiment of sensing assembly 600. Mail is moved through sensing assembly 600, preferably by a conveyor system 604. A sensor 602 is positioned to sense mail items passing through the mail processing system. In an illustrative embodiment, sensor 602 includes a radiation source and a receiver or detector positioned so that mail items pass between them. Sensor 602 is electrically connected to a feeder assembly 606. For example, the detector may cause a relay to turn a feeder motor off or on in accordance with whether mail items are passing the detector. Upon sensing a mail item, sensor 602 sends a signal to feeder assembly 606 to reduce the flow rate of mail which may keep mail from backing up in the system. Preferably the flow rate is reduced to zero upon sensing a mail item.

Further disclosed is a mail sensing method used in a mail processing assembly. The method comprises feeding mail items into the mail processing assembly and sensing the items, whereupon when an item is sensed the flow rate of mail items is reduced.

FIG. 2 depicts an embodiment of a mail sensing system as used in conjunction with the double separator assembly. Sensor 222, such as a photocell, detects a mail item in the double separator assembly. Upon such detection it stops mail being fed into the double separator assembly. In this manner double fed items may be separated and processed without mail backing up in the system.

While the invention has been described by illustrative embodiments, additional advantages and modifications will occur to those skilled in the art. Therefore, the invention in its broader aspects is not limited to specific details shown and described herein. Modifications, for example, to the conveyor system layout or materials used in the systems, may be made without departing from the spirit and scope of the invention. Accordingly, it is intended that the invention not be limited to the specific illustrative embodiments but be interpreted within the full spirit and scope of the appended claims and their equivalents.

What is claimed is:

1. A double separator assembly for a mail processing system comprising:

a conveyor system to facilitate movement of mail items through the double separator assembly;

a substantially nonrotatable friction component positioned proximate to the conveyor system; and a mail driving assembly positioned proximate to the conveyor system, downstream from the friction component, and in functional relation thereto, including an idler roller and a force generating device to hold a mail item against the conveyor system.

2. The double separator assembly of claim 1 further comprising:

a mail sensing assembly wherein the mail sensing assembly is positioned to sense mail items passing into the mail driving assembly and provides a signal to regulate the flow rate of mail items into the double separator assembly.

3. The double separator assembly of claim 1 wherein the conveyor system comprises a mail feed conveyor, a friction assembly conveyor system and a driving assembly conveyor system.

4. The double separator assembly of claim 3 wherein the mail feed conveyor system comprises one or more mail feed belts, and a plurality of mail feed rollers wherein the mail feed belt(s) are functionally supported by the mail feed rollers.

5. The double separator assembly of claim 3 wherein the friction assembly conveyor system comprises at least one friction assembly belt, and a plurality of friction assembly rollers wherein the friction assembly belt(s) are supported by the friction assembly rollers such that the belts are substantially tangent to the friction component.

6. The double separator assembly of claim 3 wherein the driving assembly conveyor system comprises a plurality of driving assembly rollers, at least one driving assembly belt, the assembly belt(s) functionally supported by the driving assembly rollers such that the driving belt(s) are substantially tangent to the idler roller and at least one roller providing motion to the belt(s).

7. The double separator assembly of claim 3 wherein the force generating device holds the mail item against the driving assembly conveyor.

8. The double separator assembly of claim 1 further comprising a friction assembly adjustment mechanism.

9. The double separator of claim 8 wherein the mechanism is a hinge in functional relation to the friction component.

10. The double separator assembly of claim 1 further comprising a driving assembly adjustment mechanism.

11. The double separator assembly of claim 10 wherein the mechanism is a hinge in functional relation to the idler roller.

12. The double separator assembly of claim 1 wherein the force generating device is a vacuum.

13. The double separator assembly of claim 12 wherein at least one driving assembly belt comprises one or more openings through which the vacuum may be drawn to hold the mail item against the belt.

14. The double separator assembly of claim 2 wherein the mail sensing assembly comprises a light source and a light detector in functional relation to one another.

15. The double separator assembly of claim 14 wherein the conveyor system comprises one or more belts and the path of light between the light source and the light sensor is at least partially through one or more openings in the one or more conveyor system belts.

16. The double separator assembly of claim 15 wherein the openings are in a belt in the driving assembly conveyor system.

17. The double separator assembly of claim 6 wherein the driving assembly conveyor system comprises three driving assembly belts substantially parallel to one another wherein one or more of the three belts is provided with one or more openings through which a vacuum is drawn.

18. The double separator assembly of claim 5 wherein the friction assembly conveyor system comprises two friction assembly belts substantially parallel to one another and disposed around the friction assembly rollers wherein the rollers are driven by a feeder system belt disposed on at least one of the friction assembly rollers.

19. The double separator assembly of claim 13 wherein the openings are in a grouped pattern that measures in the range of about 10 to about 15 inches along the length of the belt.

20. The double separator assembly of claim 1 wherein the friction component comprises a material selected from the group consisting of neoprene, polyurethane, grinding wheel material, and sand paper.

21. The double separator assembly of claim 20 wherein the friction component comprises a grinding wheel.

22. A mail processing system comprising a double separator assembly according to claim 1.

23. A double separator assembly for a mail processing system comprising:

a conveyor system to facilitate movement of mail items through the double separator assembly;

a substantially nonrotatable friction component positioned proximate to the conveyor system; and a mail driving assembly positioned proximate to the conveyor system, downstream from the friction component, and in functional relation thereto, including an idler roller and a force generating device to hold a mail item against the conveyor system; and an adjustment mechanism having a hinge in functional relation to the friction component.

24. A mail processing system comprising:

a feeder assembly for receiving a plurality of mail items, the feeder assembly having a double separator assembly;

the double separator having:

a conveyor system to facilitate movement of mail items through the double separator assembly;

a substantially nonrotatable friction component positioned proximate to the conveyor system; and a mail driving assembly positioned proximate to the conveyor system, downstream from the friction component, and in functional relation thereto, including an idler roller and a force generating device to hold a mail item against the conveyor system, wherein the friction component separates a double fed mail item;

a sorter assembly in functional cooperation with and proximate to the feeder assembly to receive mail therefrom and sort mail items into categories; and a delivery assembly in functional cooperation with and proximate to the sorter assembly for delivery of sorted mail items to corresponding receptacles.

* * * * *